US008393820B2

(12) United States Patent
Rodriguez

(10) Patent No.: US 8,393,820 B2
(45) Date of Patent: Mar. 12, 2013

(54) ROTATIONALLY LOCKED DRIVE ASSEMBLY FOR A VSI CRUSHER

(76) Inventor: Damian Rodriguez, Livermore, CA (US)

( * ) Notice: Subject to any disclaimer, the term of this patent is extended or adjusted under 35 U.S.C. 154(b) by 214 days.

(21) Appl. No.: 12/825,966

(22) Filed: Jun. 29, 2010

(65) Prior Publication Data

US 2010/0266335 A1 Oct. 21, 2010

Related U.S. Application Data

(63) Continuation-in-part of application No. 11/823,532, filed on Jun. 27, 2007, now Pat. No. 7,744,302.

(51) Int. Cl.
*E21B 10/36* (2006.01)

(52) U.S. Cl. ..... 403/355; 175/320; 175/415

(58) Field of Classification Search ..... 403/319, 403/355, 365, 370, 383; 241/191, 277, 278.1; 175/320, 415; 299/41.1
See application file for complete search history.

(56) References Cited

U.S. PATENT DOCUMENTS

| | | | | |
|---|---|---|---|---|
| 1,472,565 | A * | 10/1923 | Manning | 403/370 |
| 3,920,089 | A * | 11/1975 | Mitchell | 175/320 |
| 3,993,147 | A * | 11/1976 | Mitchell | 175/344 |
| 6,786,671 | B1 * | 9/2004 | Eckendorff | 403/365 |
| 7,267,502 | B2 * | 9/2007 | Sawai | 400/641 |

* cited by examiner

*Primary Examiner* — Michael P Ferguson
(74) *Attorney, Agent, or Firm* — Brian Beverly; Beeson Skinner Beverly, LLP

(57) ABSTRACT

A rotationally locked drive assembly for a VSI crusher comprises a drive shaft 52 rotatably securable in a bearing cartridge assembly 60, the drive shaft having a tapered upper end portion 62 for forming a taper joint in cooperation with the tapered central opening 72 of a flywheel 54, a top opening key receptor 81 formed on the top surface 76 of the flywheel for receiving a locking key 56, whereby tightening of fasteners 58 secures locking key 56 in key receptor 81, presses flywheel 54 onto drive shaft 52, thereby fortifying the taper joint between the flywheel 54 and drive shaft 52, and locking drive shaft 52, flywheel 54 and locking key 56 in rotational alignment.

16 Claims, 8 Drawing Sheets

ROTATIONALLY LOCKED DRIVE ASSEMBLY FOR A VSI CRUSHER

CROSS-REFERENCE TO RELATED APPLICATIONS

This application is a continuation-in-part of application Ser. No. 11/823,532, filed Jun. 27, 2007.

FIELD OF THE INVENTION

This invention is directed to vertical shaft impact (VSI) crushers and in particular to components of the drive assembly of a VSI crusher that are locked in rotational alignment for providing a secure and robust connection between the rotating drive shaft and the impeller of the crusher.

BACKGROUND

VSI-type crushers operate as high-speed "rock pumps." The receipt, acceleration and discharge of rock feed introduced to this type of rock crusher passes through a rotating impeller. Broadly speaking, impellers are referred to in the art as either "open" or "enclosed." Enclosed impellers include a floor, a perimeter wall, and a disk-like ceiling, and are frequently described as a rock-lined rotor. An open impeller, commonly referred to as a shoe table, does not have a ceiling but has a number of anvils on the floor of the device for impacting and pulverizing materials introduced into the device. The nature of the drive system connecting the drive shaft to the impeller is equally applicable to both open and closed impellers.

The impeller is supported in the machine by a drive shaft 12 which is held by and turns in a bearing cartridge assembly 14, as shown in FIGS. 1-4, in a housing (not illustrated) centered within the machine. The rotating shaft 12 imparts torque onto the spinning impeller 44. The initial point of impact for the incoming rock mineral feed is the center of the rock-lined impeller directly below which is a mechanical connection between the impeller 44 and the shaft 12.

A popular method of affixing the impeller 44 to the shaft 12 is by the use of a taper lock type of arrangement in which a tapered outer surface 16 of a taper lock 18 and a cooperating tapered inner surface 20 of an impeller boss 22 are drawn together using a top plate 24 and several bolts 26, 28. See FIGS. 2 and 3. Commonly, the taper lock 18 is installed on and around the upper end of shaft 12. A cover plate 40 protects the top of the bearing cartridge assembly 14. The impeller boss 22, which is very firmly attached to the impeller 44, is lowered over and around taper lock 18. Top plate 24 is then secured to impeller boss 22 with a first set of bolts 26 which pass through outer apertures 27 in top plate 24 and are threaded into bolt holes 46 in impeller boss 22. A second set of bolts 28 passes through inner apertures 29 in top plate 24 and is threaded into bolt holes 48 in taper lock 18. As the second set of bolts 28 are tightened, top plate 24 and impeller boss 22 are drawn downward towards taper lock 18. When properly tightened, the bolts 26, 28 cause a sliding interference fit between the outer surface 16 of the taper lock 18 and the inner surface 20 of the impeller boss 22. A taper lock fitting thus establishes maximum surface contact between the adjoining parts and achieves a high-pressure, compressed, non-slipping joint through which driving torque is transferred from the shaft 12 to the impeller 44. In addition to providing a strong mechanical joint between the taper lock 18 and the impeller boss 22, use of the taper lock joint allows for easy disassembly of the parts by loosening the bolts which draw the tapered surfaces 16, 20 of the taper lock 18 and the impeller boss 22 together. Thereafter, a small amount of axial movement relieves compression at the tapered surfaces.

A conventional key system acts as a backup to minimize or eliminate any rotational slipping between the parts, ensuring that all the components rotate as one. The taper lock 18 is keyed to the shaft 12 using a longitudinal keyway 32 in the shaft 12 into which is fitted a key 34. There is a mating keyway 36 in the bore 38 of the taper lock 18 which matches and slides over key 34. This forms a positive mechanical connection between the shaft 12 and the impeller 44. See FIGS. 1-4.

While the conventional taper lock-and-keyway design is effective and generally reliable, it is not ideal for application in a VSI-type crusher where extensive vibrational forces and unpredictable shock loadings routinely occur. Due to manufacturing tolerances and variances, weaknesses can develop that undermine the system. Minute differences between the exterior surface of the shaft and the interior surface of the taper lock lead to "fretting," the microscopic movement of material under high pressure. Poorly machined surfaces can lead to "notches" in the shaft, along the shaft keyway, or in the taper lock bore. As the shaft is typically a hardened steel alloy, it is vulnerable to the phenomena of "notch sensitivity." This works similarly to the etching of glass wherein a small imperfection in the material may become the focal point for cracking and part failure. Extended use can result in pitting and poor surface conditions. Finally, experience has shown that a high proportion of shaft failures occur in that portion of the shaft adjacent the bottom of the taper lock where a bending moment is formed by the collective weight of the taper lock 18, impeller boss 22, and impeller 44 resting on the shaft 12. In concert, these irregularities can cause unique loading conditions and stress concentrations which may result in shaft failure.

In the normal operation of a VSI-type crusher, the impeller is routinely removed and re-installed for purposes of maintenance. In some instances, multiple impellers may be applied to the same shaft and taper lock. All of this removal and re-installation distresses the parts of the taper lock assembly, especially the main shaft, with the result that, as the VSI crusher ages, the main shaft becomes more vulnerable.

A need therefore exists for a robust joint between the drive shaft and the impeller that reduces failures due to notch sensitivity, reduces the propensity for shaft failure at the bottom of the taper joint, and that speeds and facilitates removal and reinstallation of the impeller for maintenance purposes.

SUMMARY OF THE INVENTION

A rotationally locked drive assembly for a VSI crusher provides an assembly that effectively transfers torque from the drive shaft to the impeller, protects the main shaft from the types of distress discussed above that can lead to premature failure, and is fast and simple to disassemble and reassemble for maintenance purposes.

The impeller boss 22 and taper lock 18 of a conventional drive assembly are replaced with a flywheel having a tapered center opening. A tapered upper end portion of the shaft is removably received in the correspondingly tapered center opening of the flywheel to form a robust taper joint between the drive shaft and the flywheel. A locking key having a plurality of extensions radiating from a central body is secured in a key receptor formed on the top surface of the flywheel to hold the drive shaft in rotational alignment with the flywheel. The locking key is held in place by fasteners engaged with the upper end portion of the drive shaft. Tightening of the fasteners (a) attaches the locking key to the upper end portion of the drive shaft, (b) secures the locking key in the key receptor and (c) compresses the flywheel onto the tapered upper end portion of the shaft thus fortifying the taper joint. The assembly eliminates the longitudinal keyway 32 in the shaft 12 present in the conventional key system, thereby removing opportunities for fretting and notching as discussed above. The same type of taper joint used in the conventional system locks the improved drive assembly together as one, but the back up system to ensure against rotational slipping has been changed from the key and keyway in the shaft to the locking key which is secured in the key receptor formed in the top of the flywheel and attached to the upper end portion of the drive shaft. The locking key mates to the drive shaft by fitting a square center opening in its central body over a square pilot key on the top face of the drive shaft. Locking to the flywheel is achieved by four outwardly-radiating extensions of the locking key engaging four cooperating slots formed in the key receptor. The new drive assembly rotationally aligns all components securely, does not interfere with the ability to loosen the assembly's grip on the drive shaft quickly by axial movement of the flywheel such as when using the conventional key design, and simplifies and reduces the number of components in the drive assembly thereby facilitating maintenance and reducing the opportunities for component failures.

BRIEF DESCRIPTION OF THE ILLUSTRATIONS

DETAILED DESCRIPTION OF THE ILLUSTRATED EMBODIMENT

Figure 5:
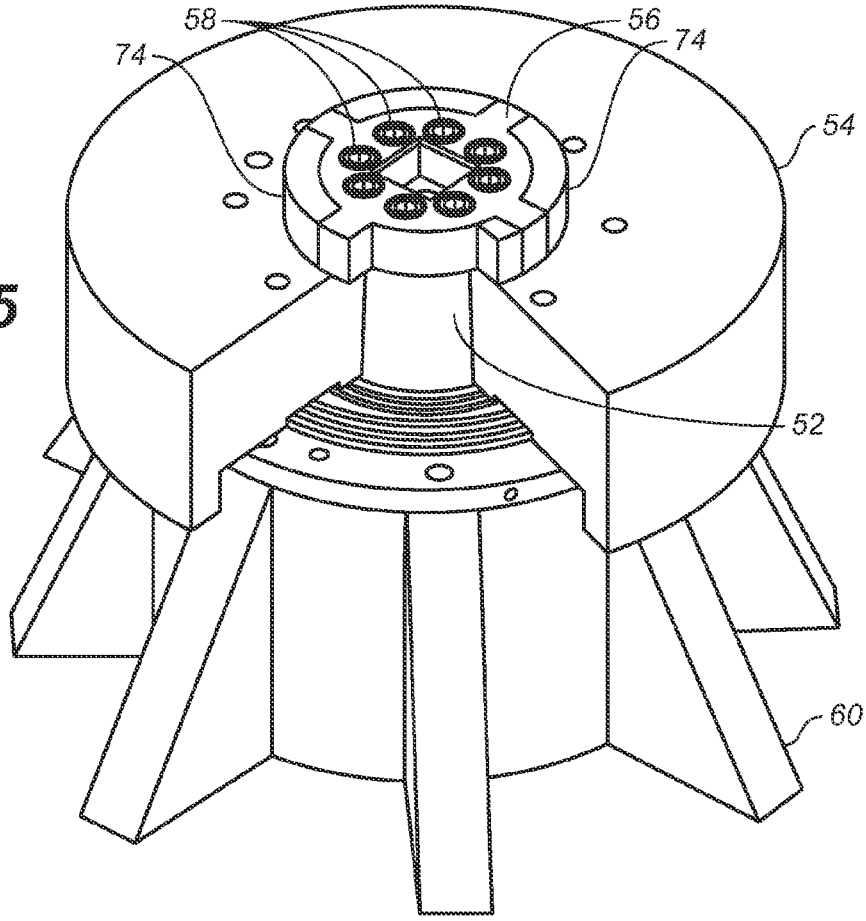
FIG. 5 is an upper perspective view of a rotationally locked drive assembly for a VSI crusher according to the invention, wherein the impeller boss is partially broken away to show a portion of a bearing cartridge, a drive shaft and a locking key.
Figure 6:
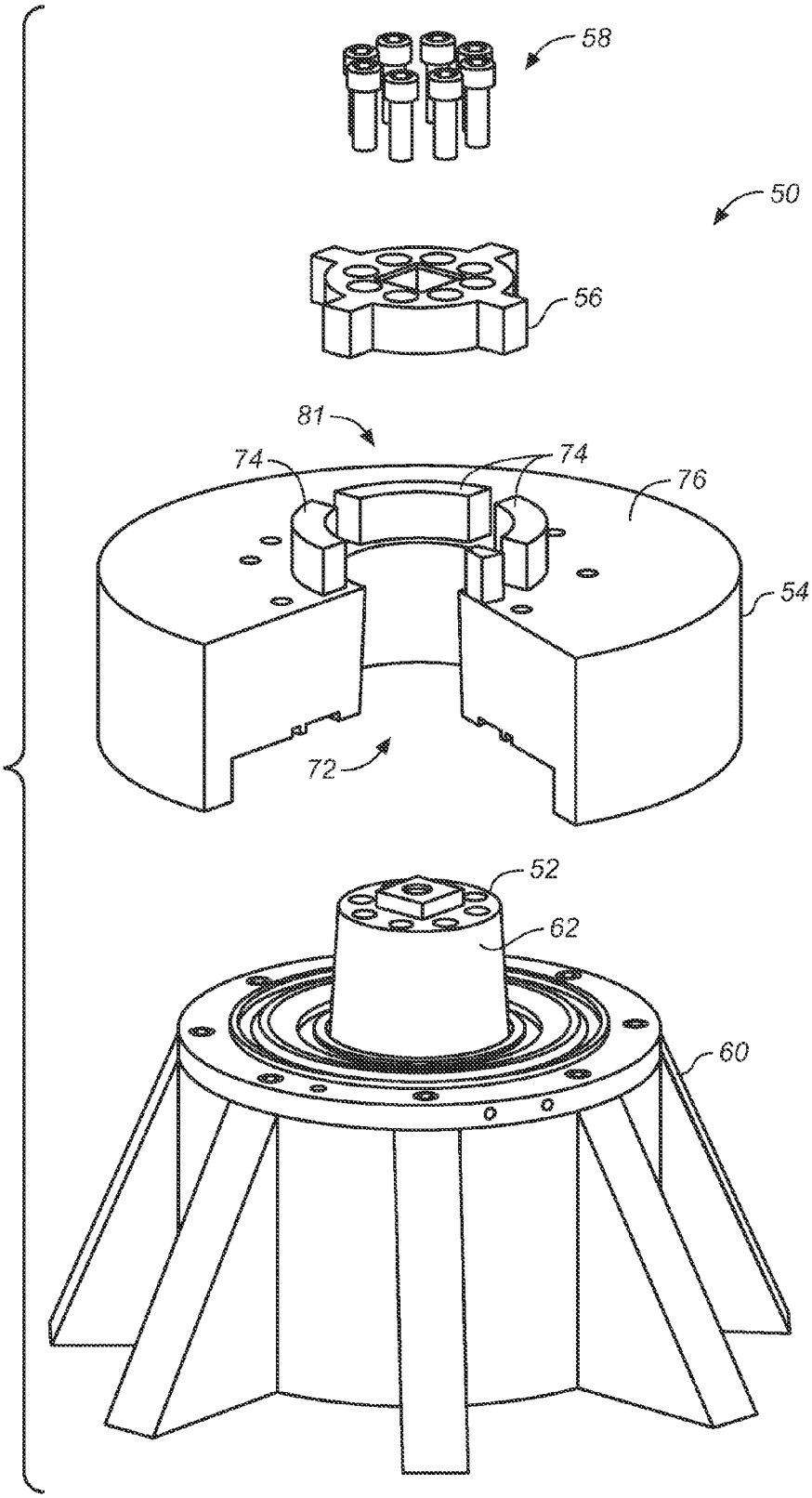
FIG. 6 is an exploded upper perspective view of the rotationally locked drive assembly for a VSI crusher shown in FIG. 5.
Figure 7:
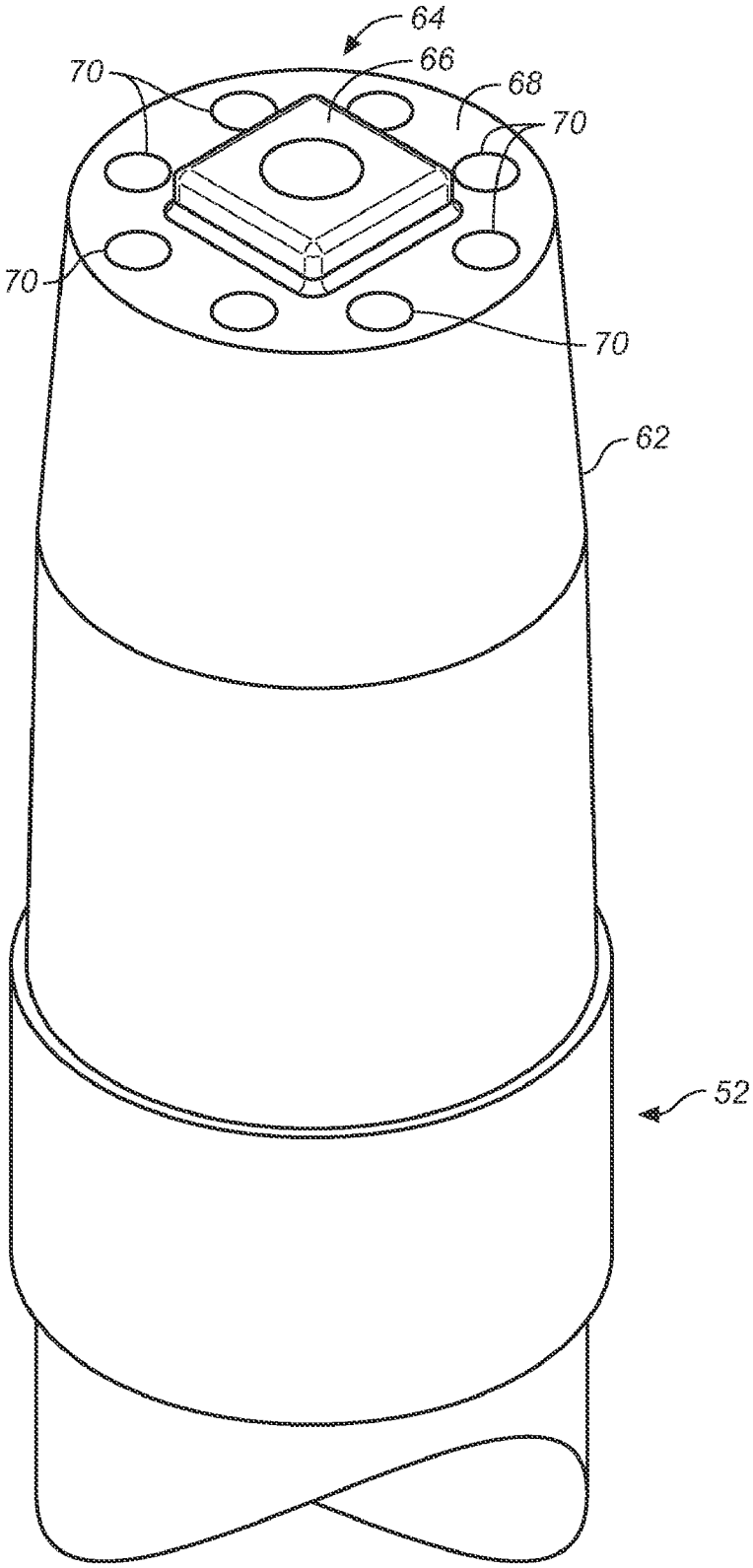
FIG. 7 is an enlarged upper perspective view of the drive shaft thereof.

A rotationally locked drive assembly for a VSI crusher 50 is now described with reference to FIGS. 5 and 6 and comprises a drive shaft 52, a flywheel 54, a locking key 56, and fasteners 58. The drive shaft 52 is rotatably secured in a bearing cartridge assembly 60 and has a tapered upper end portion 62 and a top face 64. See also FIG. 7. A pilot key 66 extends upwardly from the top face 64 and is surrounded by a generally annular floor 68. A plurality of threaded apertures 70 in the upper end portion 62 open in top face 64.

Figure 1:
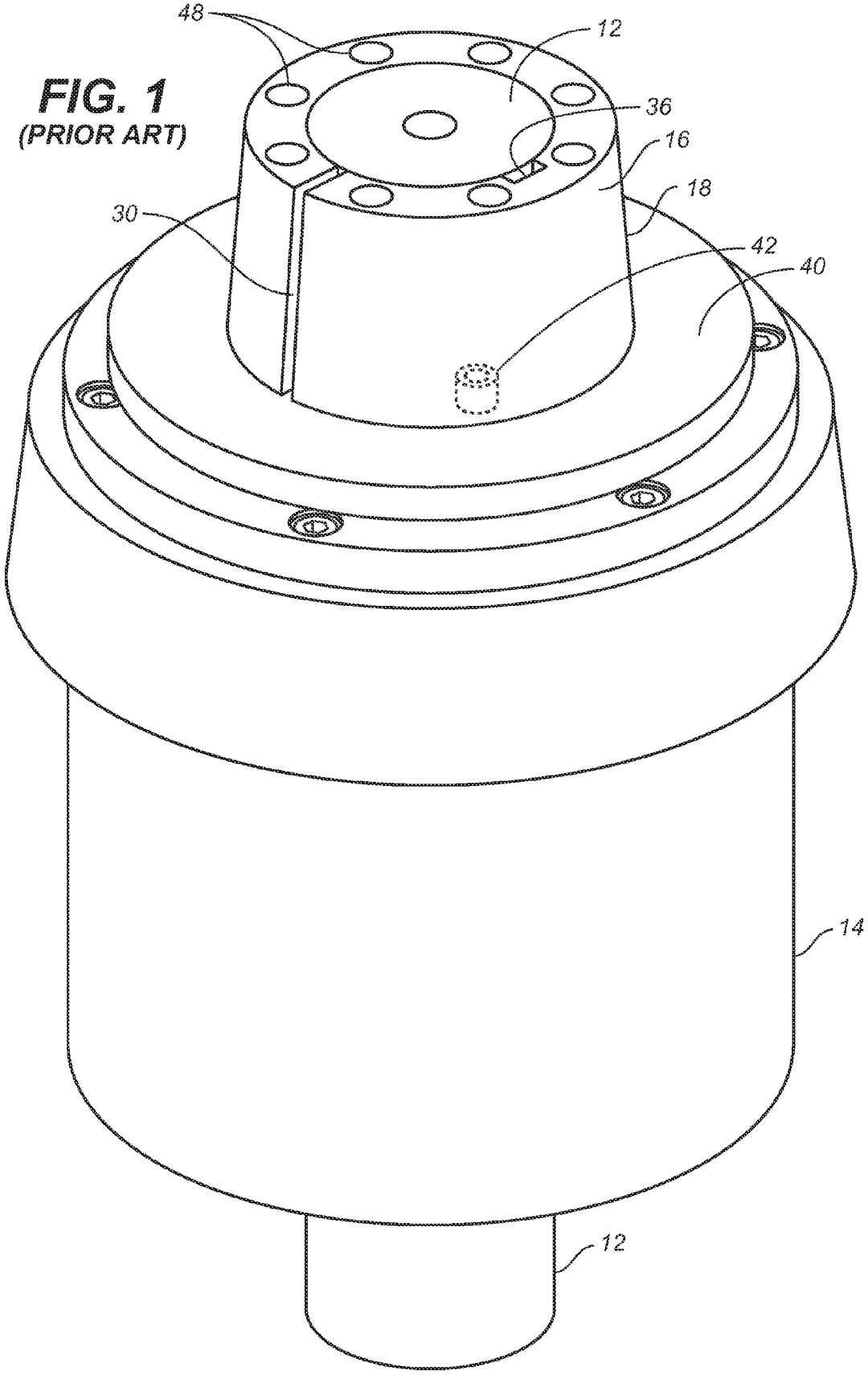
FIG. 1 (PRIOR ART)
FIG. 1 is a perspective view showing prior art core components of a VSI mineral breaker, including a bearing cartridge assembly, shaft, and taper lock.
Figure 2:
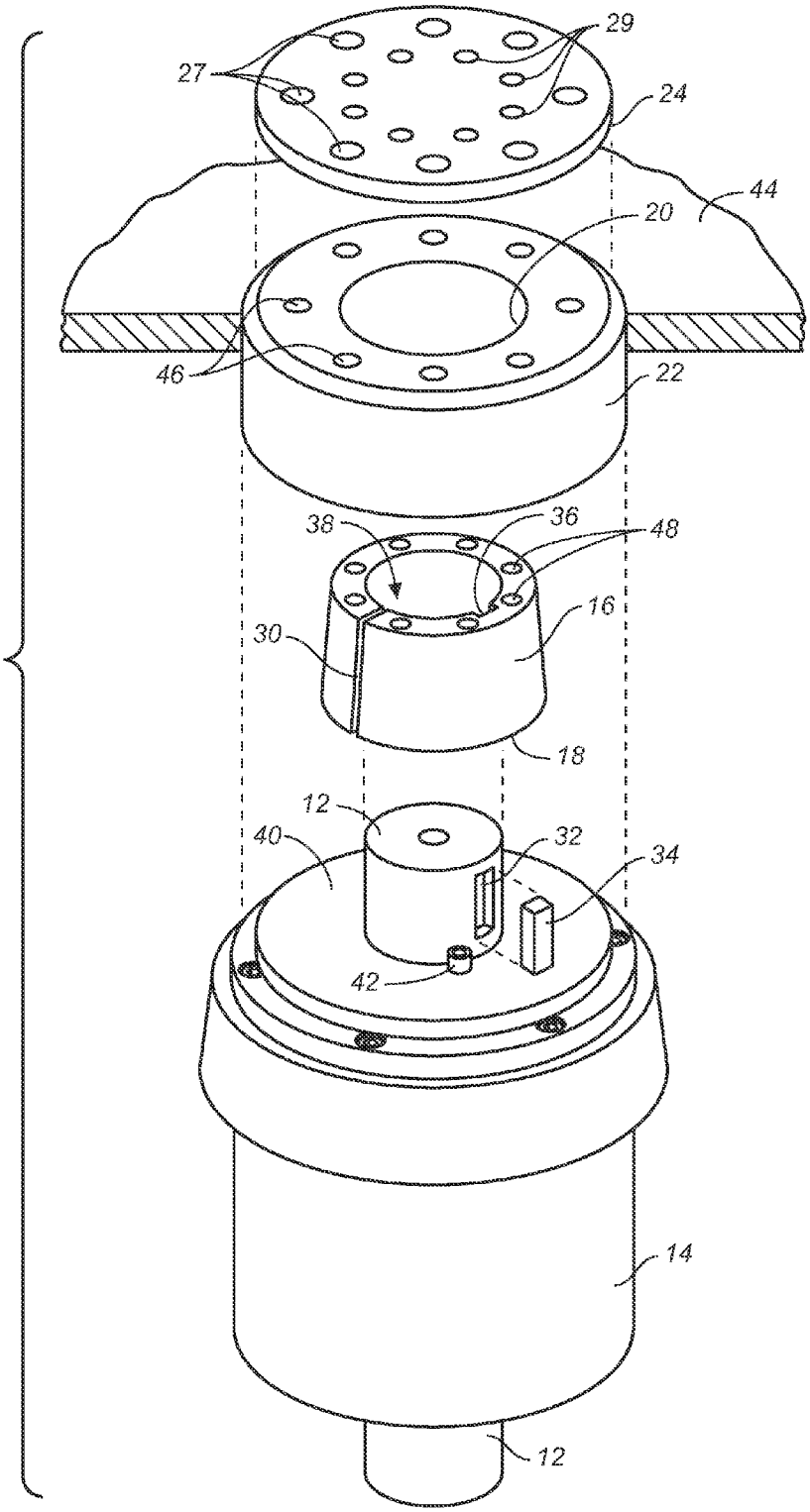
FIG. 2 (PRIOR ART)
FIG. 2 is an exploded perspective view of the VSI crusher components shown in FIG. 1 together with an impeller boss, top plate, and a portion of an impeller according to the prior art.
Figure 3:
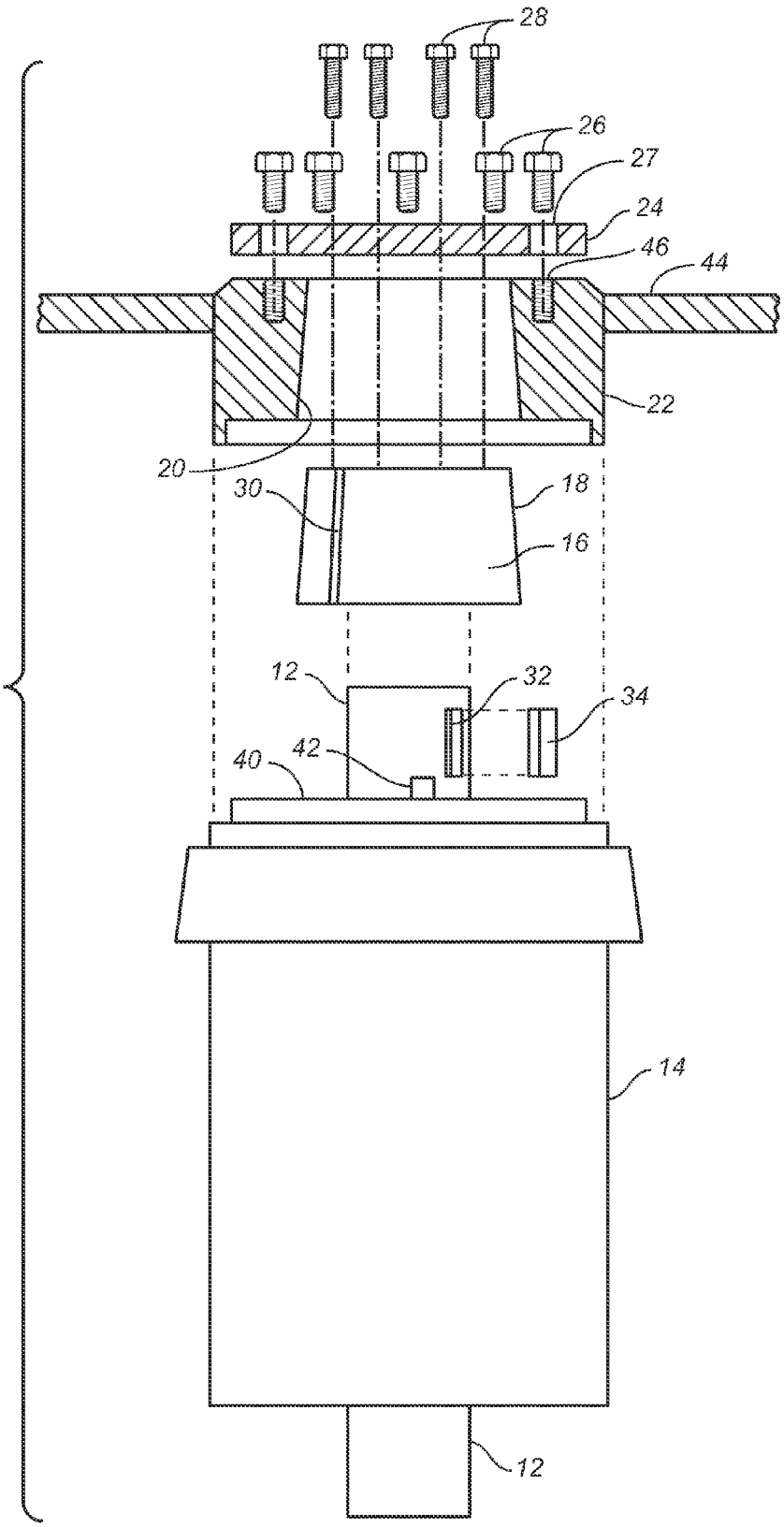
FIG. 3 (PRIOR ART)
FIG. 3 is an exploded elevation view of the prior art VSI crusher components shown in FIG. 2, also showing bolts used to join the components together, wherein the impeller boss, impeller and top plate are shown in sectional view.
Figure 4:
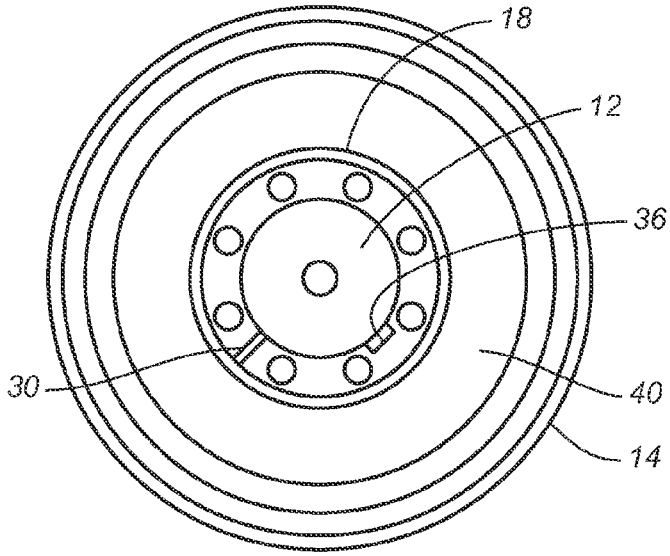
FIG. 4 (PRIOR ART)
FIG. 4 is a top plan view of the prior art VSI crusher components shown in FIG. 1.
Figure 8:
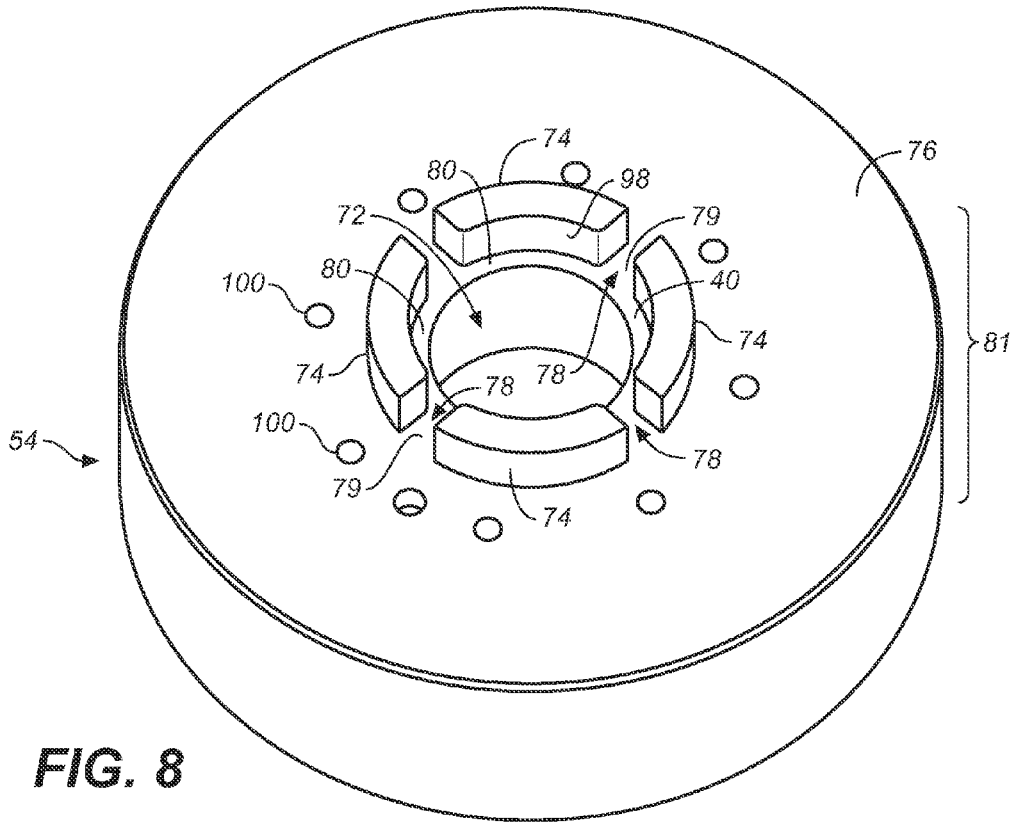
FIG. 8 is an enlarged upper perspective view of the flywheel thereof.

Referring now to FIG. 8, the flywheel 54 has a center opening 72 sized and tapered to correspond to the tapered upper end portion 62 of shaft 52. Four rampart walls 74 surrounding the center opening 72 extend upwardly from the top surface 76 of flywheel 54. Each rampart wall 74 is separated from adjoining rampart walls by slots 78 and are set back from the center opening 72 forming an annular receiving surface 80 immediately surrounding opening 72. A top opening key receptor 81 for receiving the locking key 56 discussed below is thus formed by rampart walls 74, slots 78, and annular receiving surface 80, and the annular receiving surface 80 and the bottom surfaces 79 of slots 78 together form a seating surface within the key receptor 81 for the locking key 56. See FIGS. 6 and 8. Although in the illustrated embodiment there are four rampart walls, it is not intended that the invention be restricted to four rampart walls, it being understood that there could be less than or more than four rampart walls. Further, while the illustrated embodiment shows slots separating adjacent rampart walls, it should be understood that the invention embraces other recesses or openings designed to receive the radial extensions of the locking key discussed below, such as inwardly facing recesses disposed at intervals in a continuous rampart wall surrounding the center opening. The impeller (not illustrated, but similar to impeller 44 shown in FIG. 2) is attached to the top surface 76 of the flywheel 54 and around rampart walls 74 via fasteners received and tightened in impeller fastener apertures 100.

Figure 9:
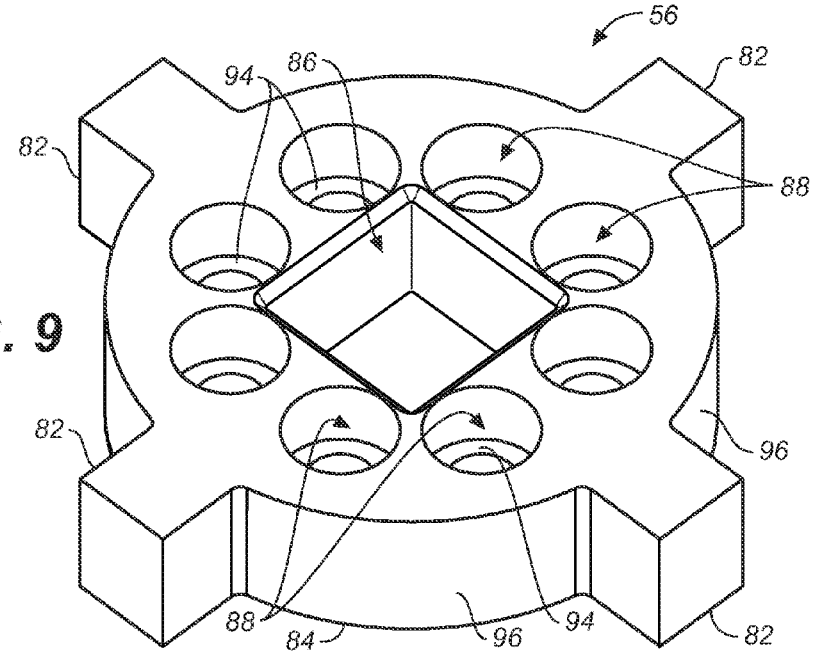
FIG. 9 is an enlarged upper perspective view of the of the locking key thereof.
Figure 10:
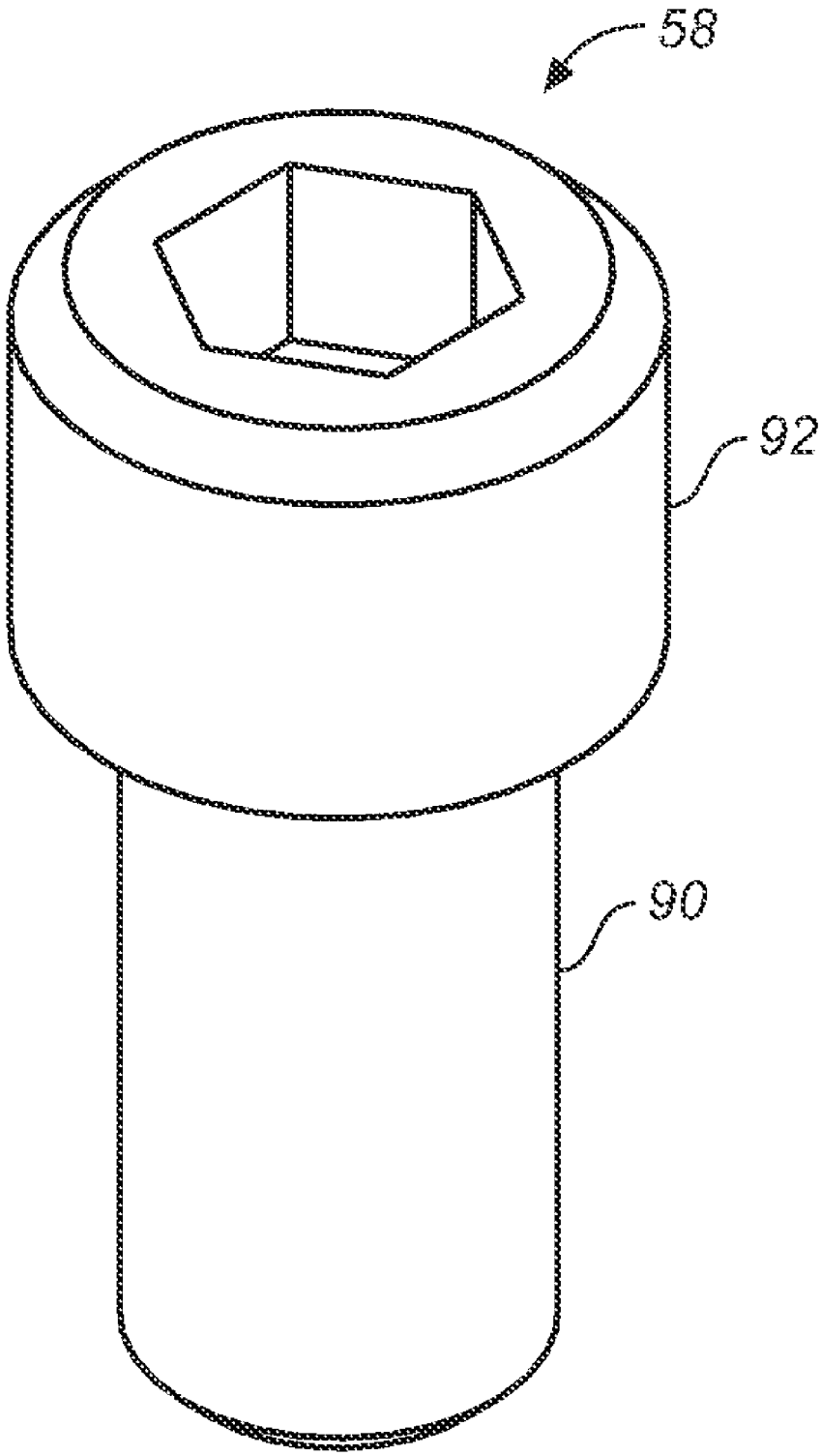
FIG. 10 is an enlarged upper perspective view of one of the fasteners thereof.

Locking key 56 comprises a plurality of extensions 82 radiating from a central body 84. See FIG. 9. A center aperture 86 in central body 84 is sized and dimensioned to closely receive the pilot key 66 on the top face 64 of shaft 52. It will be understood that it is not strictly necessary for the pilot key 66 and center aperture 72 to be square, and each may be otherwise shaped, e.g., rectangular or hexagonal, so long as they are cooperatively dimensioned for a close fit. A plurality of fastener receiving holes 88 are formed in the central body 84 for receiving fasteners 58. Fasteners 58 each comprise a fastener shaft 90 and fastener head 92 having a diameter greater than the fastener shaft. See FIG. 10. A recessed floor 94 in each of the receiving holes 88 provides a stop surface for the bottom of the fastener head 92 such that they are rotatably received in and held by each fastener receiving hole 88. Those of skill in the art will recognize that other cooperative formations of fasteners and fastener receiving holes are possible that hold the fastener head on or in the locking key, but the illustrated embodiment has the advantage that fastener heads 92 are fully recessed in locking key 56 when the device is fully assembled as shown in FIG. 5. Central body 84 has a generally annular perimeter face 96 closely corresponding to the annular inner faces 98 of rampart walls 74 (see FIGS. 6, 8 and 9). But it should be understood that both the perimeter shape of central body and the inner face of the rampart walls could shaped in other ways giving, for example, the central body an overall square configuration with the extensions at each corner.

The drive assembly 10 is assembled by positioning flywheel 54 on drive shaft 52 such that the drive shaft 52 is tightly received in the central opening 72 of the flywheel 54 thereby forming a robust taper joint between flywheel 54 and drive shaft 52. Thereupon locking key 56 is set in key receptor 81 with the central body 84 thereof disposed between rampart walls 74 and seated on the annular receiving surface 80 of the flywheel 54, with extensions 82 removably received in and seated on the bottom surfaces 79 of slots 78, and oriented such that the pilot key 66 on the top face 64 of the drive shaft 52 is removably received in the locking key's center opening 86. It should be noted that at this stage of assembly locking key 56 can easily be removed from key receptor 81. Assembly is completed by insertion of fasteners 58 through fastener receiving holes 88 and into threaded apertures 70 in the upper end portion 62 of shaft 52. Tightening of fasteners 58 firmly attaches locking key 56 to the upper end portion 62 of drive shaft 52, secures locking key 56 in key receptor 81, presses flywheel 54 onto drive shaft 52 thereby fortifying the taper joint between the flywheel 54 and drive shaft 52, and locks drive shaft 52, flywheel 54 (and attached impeller) and locking key 56 in rotational alignment, as shown in FIG. 5. A tremendously strong joint is in this way formed between the component parts of the drive assembly which is remarkably quick and easy to disassemble when needed for maintenance or inspection purposes. Precious labor costs are thus saved, costly down time of the crusher is minimized, and due to the simplicity of the parts, manufacturing costs are reduced.

In one embodiment of the invention, the rampart walls 74 can be moved inwardly so that their inner faces 98 are not inset from center opening 72. This eliminates annular receiving surface 80 so that when locking key 56 is seated in key receptor 81, only extensions 82 are resting on the bottom surfaces 79 of slots 78.

In another embodiment of the invention, the pilot key 66 on the top face 64 of the drive shaft 62 and the center opening 86 of the locking key 56 are eliminated.

There have thus been described certain preferred embodiments of a rotationally locked drive assembly for a VSI crusher. While preferred embodiments have been described and disclosed in some detail, it will be recognized by those with skill in the art that modifications are within the true spirit and scope of the invention. The appended claims are intended to cover all such modifications.

I claim:

1. A rotationally locked drive assembly for a VSI crusher, the VSI crusher having a bearing cartridge assembly and an impeller rotatably connected thereto, the rotationally locked drive assembly comprising:

a drive shaft rotatably securable in the bearing cartridge assembly, the drive shaft including a tapered upper end portion having one or more threaded apertures, a unitary locking key having a central body, a plurality of integral extensions radiating from said central body, and one or more fastener receiving holes, a flywheel for removably securing the impeller thereto, the flywheel having a top surface, a tapered center opening and a top opening key receptor, said tapered center opening extending downwardly from said top surface and shaped to correspond to the tapered upper end portion of said drive shaft, said top opening key receptor extending upwardly from said top surface for locking said locking key in rotational alignment with said flywheel, said locking key removably received in said key receptor, the upper end portion of said drive shaft removably received in said center opening forming a taper joint between said drive shaft and said flywheel, and one or more fasteners, each of said fasteners having a fastener head and a threaded fastener shaft, each of said fasteners received in one of the fastener receiving holes of the locking key such that the fastener head of each of said fasteners is rotatably retained by said locking key, each of said fasteners received in one of the threaded apertures of said drive shaft, such that tightening said fasteners secures said locking key to the upper end portion of said drive shaft, captures said locking key in said key receptor and presses said flywheel onto said drive shaft to fortify said taper joint.

2. The rotationally locked drive assembly of claim 1 wherein:

said drive shaft has a vertically oriented longitudinal axis.

3. The rotationally locked drive assembly of claim 1 wherein:

said key receptor includes one or more rampart walls extending upwardly from the top surface of said flywheel, said one or more rampart walls having a plurality of inwardly opening slots, and the plurality of extensions of said locking key is removably received in said plurality of inwardly opening slots.

4. The rotationally locked drive assembly of claim 3 wherein:

the central body of said locking key is abutting said one or more rampart walls.

5. The rotationally locked drive assembly of claim 3 wherein:

each of said plurality of slots has a horizontal bottom surface disposed in planar alignment with the top surface of said flywheel, and said plurality of extensions of said locking key is seated on said bottom surfaces.

6. The rotationally locked drive assembly of claim 5 wherein:

the top surface of said flywheel includes a top-facing generally annular receiving surface surrounding said central opening, said annular receiving surface disposed in parallel alignment with said top surface and bounded by said one or more rampart walls, and said central body is seated on said annular receiving surface.

7. The rotationally locked drive assembly of claim 3 wherein:

the upper end portion of said drive shaft has a top face and a pilot key extending upwardly from said top face, said pilot key having the shape of a regular polygon, and said locking key has a center aperture shaped to closely conform to the shape of said pilot key, said pilot key removably received in said center aperture.

8. The rotationally locked drive assembly of claim 7 wherein:

said pilot key is square-shaped.

9. The rotationally locked drive assembly of claim 1 wherein:

each of the fastener receiving holes of said locking key has a recessed floor, and the fastener head of each of said fasteners is rotatably seated on said recessed floor.

10. A rotationally locked drive assembly for a VSI mineral breaker, the VSI mineral breaker having a bearing cartridge assembly and an impeller rotatably connected to the bearing cartridge assembly, the rotationally locked drive assembly comprising:

a drive shaft rotatably securable in the bearing cartridge assembly, the drive shaft including a tapered upper end portion having one or more threaded apertures, a locking key having a central body, a plurality of extensions radiating from said central body, and one or more fastener receiving holes, a flywheel for removably securing the impeller thereto, the flywheel having a top surface, a tapered center opening, and a top opening key receptor, said center opening corresponding to the tapered upper end portion of said drive shaft, said upper end portion removably received in said center opening forming a taper joint between said drive shaft and said flywheel, said key receptor having one or more rampart walls and a generally annular receiving surface, said rampart walls extending upwardly from said top surface and having a plurality of inwardly opening slots, each of said slots having a bottom surface, said annular receiving surface surrounding said central opening and outwardly bounded by said rampart walls, said locking key removably received in said key receptor with said central body resting on said annular receiving surface and said extensions inserted in and resting on the bottom surface of said slots, said rampart walls holding said locking key in rotational alignment with said flywheel, and one or more fasteners, each of said fasteners having a fastener head and a threaded fastener shaft, each of said fasteners received in one of the fastener receiving holes of the locking key such that the fastener head of each of said fasteners is rotatably retained by said locking key, and each of said fasteners received in one of the threaded apertures of said drive shaft, wherein tightening said fasteners secures said locking key to the upper end portion of said drive shaft, captures said locking key in said key receptor and presses said flywheel onto said drive shaft to fortify said taper joint.

11. A rotationally locked drive assembly for a VSI mineral breaker, the VSI mineral breaker having a bearing cartridge assembly and an impeller rotatably connected to the bearing cartridge assembly, the rotationally locked drive assembly comprising:

a drive shaft rotatably securable in the bearing cartridge assembly, said drive shaft including a tapered upper end portion and a top face, said top face having an elevated pilot key surrounded by a generally annular floor, said generally annular floor having a plurality of threaded apertures, a flywheel for removably securing the impeller thereto, said flywheel having a top surface and a tapered center tapered center opening corresponding to the tapered upper end portion of said drive shaft, said upper end portion removably received in said center opening forming a taper joint between said drive shaft and said flywheel, the top surface of said flywheel having one or more rampart walls having a plurality of inwardly opening slots, said rampart walls and said slots defining a top opening key receptor, each of said slots having a bottom surface, the top surface of said flywheel also having a generally annular receiving surface surrounding said central opening and outwardly bounded by said rampart walls, a locking key having a central body and a plurality of extensions radiating therefrom, said central body having a center aperture and a plurality of fastener head receiving holes, said locking key removably received in the key receptor of said flywheel with the pilot key of the top face of said drive shaft removably received in the center aperture of said central body, said central body seated on said generally annular receiving surface and abutting said rampart walls, and said plurality of radial extensions removably received in and seated on the bottom surfaces of said slots, and one or more threaded fasteners each having a fastener head and a threaded fastener shaft, said fastener heads received in the fastener head receiving holes of the central body of said locking key and said fastener shafts threadedly received in the threaded apertures of the generally annular floor of the top face of said drive shaft, such that tightening of said one or more threaded fasteners secures said locking key to the upper end portion of said drive shaft and secures said locking key in said key receptor and presses said flywheel onto said drive shaft to fortify said taper joint.

12. The rotationally locked drive assembly of claim 11 wherein:

the generally annular receiving surface of the top surface of said flywheel is slightly elevated above the generally annular floor of the top face of said drive shaft.

13. The rotationally locked drive assembly of claim 11 wherein:

the central body of the locking key has a generally annular perimeter face, said rampart walls each have a generally annular inner surface corresponding to the annular perimeter face of the central body of said locking key, and the annular perimeter face of the central body of the locking key abuts the annular inner surfaces of said rampart walls.

14. The rotationally locked drive assembly of claim 11 wherein:

the fastener head receiving holes of said locking key are recessed such that the fastener heads are fully inset into said locking key.

15. The rotationally locked drive assembly of claim 11 wherein:

said flywheel has impeller fastener holes surrounding said one or more rampart walls for securing the impeller to said flywheel.

16. The rotationally locked drive assembly of claim 11 wherein:

the pilot key of the top face of the upper end portion of said drive shaft and the center aperture of the central body of said locking key have corresponding geometrical configurations.

* * * * *

UNITED STATES PATENT AND TRADEMARK OFFICE

CERTIFICATE OF CORRECTION

PATENT NO. : 8,393,820 B2
APPLICATION NO. : 12/825966
DATED : March 12, 2013
INVENTOR(S) : Damian Rodriguez It is certified that error appears in the above-identified patent and that said Letters Patent is hereby corrected as shown below:

In the specification
In column 4, line 55, "shape of central" should read –shape of the central–.
In column 4, line 56, "could shaped" should read –could be shaped–.
In the claims
In column 7, line 38, "tapered center" should be deleted.

Signed and Sealed this
Twenty-eighth Day of June, 2016

Michelle K. Lee

Michelle K. Lee
*Director of the United States Patent and Trademark Office*